United States Patent [19]

Gertiser

[11] Patent Number: 4,509,484

[45] Date of Patent: Apr. 9, 1985

[54] CLOSED LOOP LEAN AIR/FUEL RATIO CONTROLLER

[75] Inventor: Kevin M. Gertiser, Kokomo, Ind.

[73] Assignee: General Motors Corporation, Detroit, Mich.

[21] Appl. No.: 494,938

[22] Filed: May 16, 1983

[51] Int. Cl.[3] ..... F02M 7/10

[52] U.S. Cl. ..... 123/436; 73/116

[58] Field of Search ..... 123/419, 436; 73/116, 73/117.3, 660

[56] References Cited

U.S. PATENT DOCUMENTS

| | | | |
|---|---|---|---|
| 3,789,816 | 2/1974 | Taplin et al. | 123/436 |
| 4,092,955 | 6/1978 | Reddy | 123/436 |
| 4,271,798 | 6/1981 | Seitz et al. | 123/419 |
| 4,323,042 | 4/1982 | Woodhouse et al. | 123/436 |
| 4,337,647 | 7/1982 | Radcliffe et al. | 73/116 |
| 4,344,140 | 8/1982 | Leung | 364/431.08 |
| 4,357,662 | 11/1982 | Schira et al. | 123/419 |

FOREIGN PATENT DOCUMENTS

| | | | |
|---|---|---|---|
| 2372320 | 7/1978 | France | 123/436 |

*Primary Examiner*—Parshotam S. Lall
*Assistant Examiner*—W. R. Wolfe
*Attorney, Agent, or Firm*—Howard N. Conkey

[57] ABSTRACT

The air/fuel ratio of the mixture supplied to an internal combustion engine is controlled to a lean limit resulting in a maximum engine operating roughness at one level during off-idle operation and a higher level during idle conditions. Roughness is detected by comparing the minimum engine speed attained during each cylinder combustion cycle to the average of the minimum speeds.

4 Claims, 7 Drawing Figures

CLOSED LOOP LEAN AIR/FUEL RATIO CONTROLLER

This invention relates to a closed loop engine air/fuel ratio controller for adjusting the air-fuel mixture supplied to the engine to a lean air/fuel ratio limit, and particularly to such a system wherein the lean limit is established by a maximum desired engine operating roughness.

It is known that the fuel efficiency of an internal combustion engine may be improved by supplying an air-fuel mixture to the engine having an excess of air. It is also known that as the air-fuel mixture is leaned, the engine operating roughness increases. This roughness is the result of the variations in the engine speed over an engine operating cycle. During operation of an engine, its instantaneous speed undergoes cyclic speed changes in response to cylinder pressure variations. The engine speed increases during the combustion stroke of each one of the cylinders and decreases during the compression stroke of the next cylinder. Due to factors including variations in the cylinder-to-cylinder air/fuel ratio, the engine experiences an unevenness in its cylinder-to-cylinder speed cycles over an engine cycle. This unevenness in the speed over an engine cycle is referred to as engine operating roughness and is typically insignificant with low air/fuel ratios such as the stoichiometric ratio. However, as the air/fuel ratio is increased, the unevenness in speed becomes more pronounced as the combustion quality decreases. At some lean air/fuel ratio, the unevenness in the engine speed or engine operating roughness over an engine cycle becomes so severe that it becomes unacceptable. To obtain the economical benefits of a lean air/fuel ratio and yet not cause an unacceptable level of engine operating roughness, it has previously been proposed to control the air-fuel mixture supplied to an internal combustion engine in response to the sensed engine operating roughness to a lean ratio producing a predetermined maximum level of engine roughness. This form of closed loop air/fuel ratio control will automatically adapt to various fuels, fuel mixtures including alcohol-gasoline blends and to varying atmospheric conditions while at the same time maintaining the air/fuel ratio at the lean limit producing the maximum allowable engine operating roughness.

Various approaches for determining the level of engine roughness have been suggested. One such approach is to generate a speed normalized roughness signal which is indicative of the variations in the magnitude between successive torque impulses imparted to the engine crankshaft. This signal is obtained by measuring the period it takes the crankshaft to rotate through the same angle for each torque impulse, normalizing the period as a function of speed and comparing successive values to indicate degree of engine roughness. Another approach is to monitor the rate of change in flywheel acceleration with a high negative slope being indicative of incomplete or poor combustion quality.

The previously suggested methods of determining engine roughness require complicated processing circuitry or provide a marginal indication of engine roughness. For example, the normal deceleration of the engine after the combustion stroke does not differ significantly from the deceleration with a cylinder misfire. While the percentage of the combustion cycle spent under deceleration may be used in this situation to indicate poor combustion, total misfire rarely occurs in normal engine operation so that measuring the percentage of time that the combustion cycle is under deceleration does not provide a good indication of engine roughness in the case of marginal combustion.

In accord with one aspect of this invention, an improved roughness detection system is provided which does not require complicated processing circuitry and which provides a reliable indication of engine roughness. Applicant has found that the minimum engine speed value of each of the individual speed cycles in the instantaneous engine speed waveform provides a reliable indication of engine roughness. In general regarding this aspect of the invention, Applicant has found that the minimum engine speed value attained during the combustion cycle of each cylinder as compared to an average of the past minimum speed values is a reliable representation of the degree of engine operating roughness. The air/fuel ratio of the fuel supplied to the engine is leaned to the limit at which the low engine speed value represents a maximum desired engine operating roughness.

During engine idle operation, the engine inherently operates at a normally rougher level than during off-idle operation. When controlling the air/fuel ratio to a lean limit to produce a maximum engine operating roughness, the air/fuel ratio required during an engine idle operating condition to reduce the engine operating roughness to the same maximum allowable roughness as during off-idle conditions requires an excessively rich air/fuel ratio. In accord with a second aspect of this invention, when an engine idle operating condition is detected, the allowable engine operating roughness is increased so as to prevent the closed loop lean air/fuel ratio controller from enriching the air/fuel ratio to an excessively rich value so that the engine fuel economy may be maximized during all engine operating conditions including engine idle.

The foregoing and other aspects of this invention may be best understood by reference to the following description of a preferred embodiment of the invention and the drawings in which.

In general, the air/fuel ratio of an internal combustion engine is continually ramped in the lean direction at a slow rate while the engine roughness is being monitored. When the engine roughness resulting from the leaned air/fuel ratio attains a predetermined maximum, the air/fuel ratio is stepped in the rich direction and thereafter ramped in the rich direction at a rapid rate. When the maximum roughness level is no longer detected, the air/fuel ratio is again ramped in the lean direction at the slow rate. In this manner, the air/fuel ratio is maintained substantially at the lean limit producing the maximum desired engine roughness. At idle where the internal combustion engine inherently operates at a roughness level that may exceed the maximum off-idle roughness level even with richer air/fuel ratios, the maximum roughness level is increased and the rate of increase of the air/fuel ratio is reduced so as to provide for a smooth idle while yet retaining the benefits of the lean air/fuel ratio controller in maximizing fuel economy.

Engine roughness is detected by sensing the minimum speed value attained during the combustion cycle which occurs substantially at top dead center of the compression stroke. In the following description of the preferred embodiment, it is assumed that the minimum speed value occurs at top dead center position in each cylinder combustion cycle. The minimum speed value deviation from an average of the minimum speed values is representative of the degree of engine roughness. The maximum allowable engine roughness is represented by a predetermined offset value from the average of the minimum engine speed values.

Figure 1:
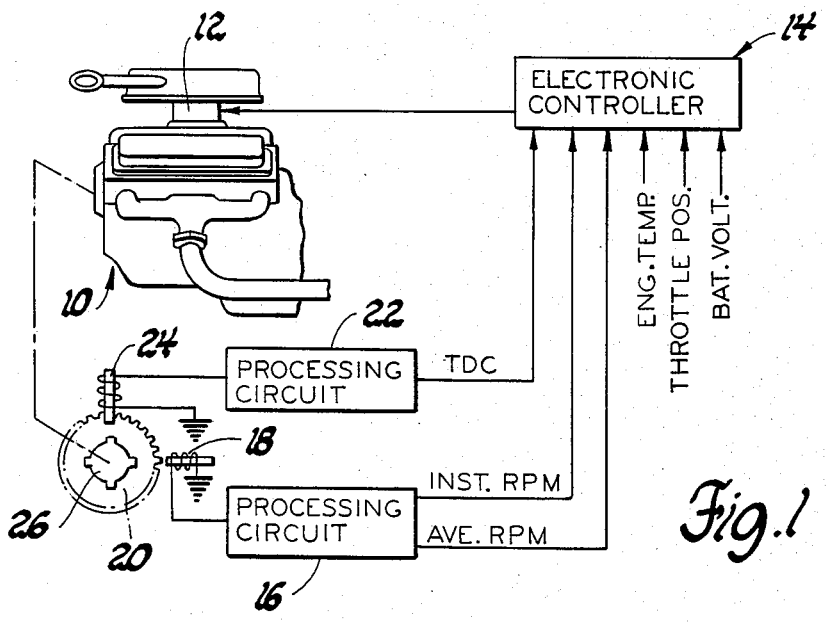
FIG. 1 illustrates generally a lean limit air/fuel ratio electronic controller for an internal combustion engine incorporating the principles of this invention.

Referring to FIG. 1, there is illustrated a system for controlling the air and fuel mixture to an internal combustion engine 10. While the invention is applicable to various fuel delivery systems including throttle body injection systems and port fuel injection systems, for purposes of illustrating this invention it is assumed that the engine 10 is supplied with a controlled mixture of fuel and air by a carburetor 12.

The air/fuel ratio of the mixture supplied by the carburetor 12 is selectively adjusted by means of an electronic controller 14 to a lean air/fuel ratio limit at which a maximum desired engine roughness is detected. This air/fuel ratio control by the controller 14 is provided in response to a number of signals including a throttle position signal provided by a conventional throttle position sensor monitoring the angular position of the throttle valve in the carburetor 12, an engine temperature signal provided by a conventional temperature sensor monitoring the engine coolant temperature, a top dead center signal, an instantaneous engine speed signal and an average engine speed signal. Operating voltage is supplied to the electronic controller from the vehicle battery via the ignition switch (not illustrated).

The instantaneous and average engine speed signals are provided by a processing circuit 16 which receives engine speed pulses provided by a magnetic pickup 18 monitoring the teeth on the engine flywheel or other disk member 20. The flywheel 20 is rotated by the engine crankshaft so that pulses having a frequency directly proportional to engine speed are provided to the processing circuit 16.

The top dead center signal coinciding with the top dead center position of each of the cylinders of the engine 10 are provided by a processing circuit 22 which receives pulses from a magnetic pickup 24 which senses teeth on a pole piece 26, each tooth aligning with the magnetic pickup 24 at top dead center position of a respective one of the pistons. In the embodiment illustrated, the engine 10 is an 8-cylinder engine and the pole piece 26 has four teeth spaced at 90 degrees with the center of each tooth being located at top dead center.

As the engine 10 is operated, the crankshaft speed undergoes cyclic variations corresponding to the torque impulses imparted thereto by each combustion event in the respective cylinders. Between combustion events, the engine speed decreases and generally attains a minimum speed at substantially top dead center of a piston during the compression stroke. This minimum speed at top dead center position is utilized in the present invention in the determination of the engine roughness in the control of the air/fuel ratio to the lean limit.

The carburetor 12 includes an air/fuel ratio adjustment device that is responsive to the signal output of the electronic controller 14 to adjust the air/fuel ratio of the mixture supplied by the carburetor 12. In the present embodiment, the control signal output of the electronic controller 14 takes the form of a pulse width modulated signal at a constant frequency thereby forming a duty cycle modulated control signal. A low duty cycle output of the electronic controller 14 provides for an enrichment of the mixture supplied by the carburetor 12 while a high duty cycle value is effective to lean the mixture. An example of a carburetor 12 responsive to a duty cycle modulated signal for adjusting the mixture supplied by both the idle and main fuel metering circuits is illustrated in the U.S. Pat. No. 4,178,332 which issued on Dec. 11, 1979, and which is assigned to the assignee of this invention. In this form of carburetor, the duty cycle modulated control signal is applied to a solenoid which adjusts elements in the fuel metering circuits to provide for the air/fuel ratio adjustment.

Figure 3:
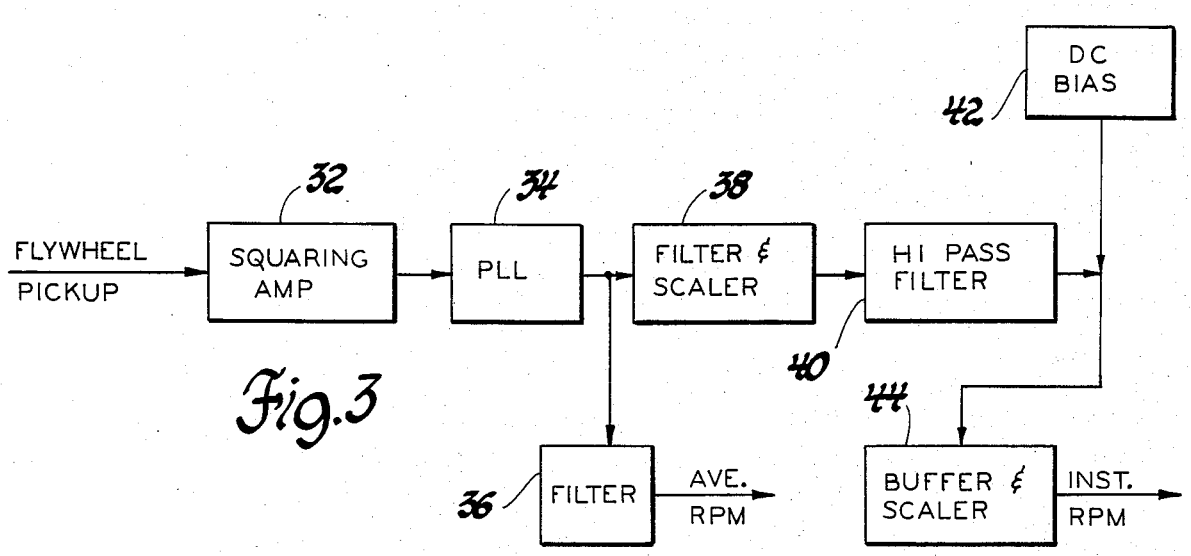
FIG. 3 is a block diagram of a circuit for providing average and instantaneous engine speed signals.

Referring to FIG. 3, a block diagram illustrating the processing circuit 16 for providing the instantaneous and average engine speed signals is illustrated. The pulse output of the magnetic transducer 18 sensing the passage of the teeth on the flywheel 20 is provided to a squaring amplifier 32 which supplies squarewave output signals at a frequency directly proportional to the instantaneous engine speed. These squarewave pulses are applied to a phase locked loop 34. The phase locked loop 34 is conventional and includes a voltage controlled oscillator and a phase comparator generating a voltage for adjusting the voltage controlled oscillator to the frequency of the input waveform. The voltage controlled oscillator DC control voltage is provided at a demodulator output terminal. The magnitude of this voltage is a measure of the instantaneous speed of the engine 10.

The output of the phase locked loop 34 is applied to a filter 36 having a time constant such that its output is a voltage that is a measure of the average engine speed. The output of the phase locked loop 34 is also applied to a filter and scaler circuit 38 which may include an amplifier with capacitive feedback for integrating the voltage spikes that are present in the output of the phase locked loop 34. The output of the filter and scaler circuit 38 is a DC voltage that is a measure of the instantaneous speed of the engine 10. A high pass filter 40 is provided to remove the large DC component of the speed signal output of the circuit 38. The corner frequency of this filter is such that it passes cylinder-to-cylinder speed variations at all engine operating speeds and also engine cyclic speed variations caused, for example, by cylinder-to-cylinder variations in the air/fuel ratio. The output of the high pass filter 40 is summed with a DC bias provided by a circuit 42, the summed signal being applied to a buffer and scaler circuit 44. The output of the buffer and scaler circuit 44 comprises the instantaneous engine speed signal referred to in FIG. 1.

Figure 4:
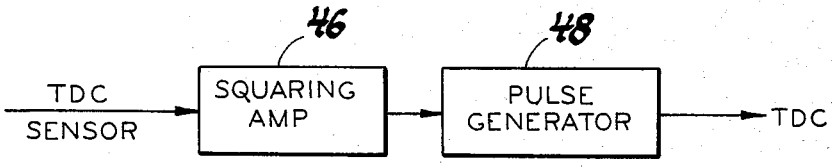
FIG. 4 is a block diagram illustrating a circuit for providing a top dead center signal to the digital computer of FIG. 2.

Referring to FIG. 4, the processing circuit 22 for providing the top dead center pulse is illustrated in block diagram. The output of the magnetic pickup 24 monitoring the teeth on the pole piece 26 is applied to a squaring amplifier 46 whose output is coupled to a pulse generator 48. The pulse generator 48 may take the form of a single shot which is triggered on the trailing edge of each pulse output of the squaring amplifier 46. The pulse output of the single shot comprises the top dead center pulse applied to the electronic controller 14 of the FIG. 1.

Figure 2:
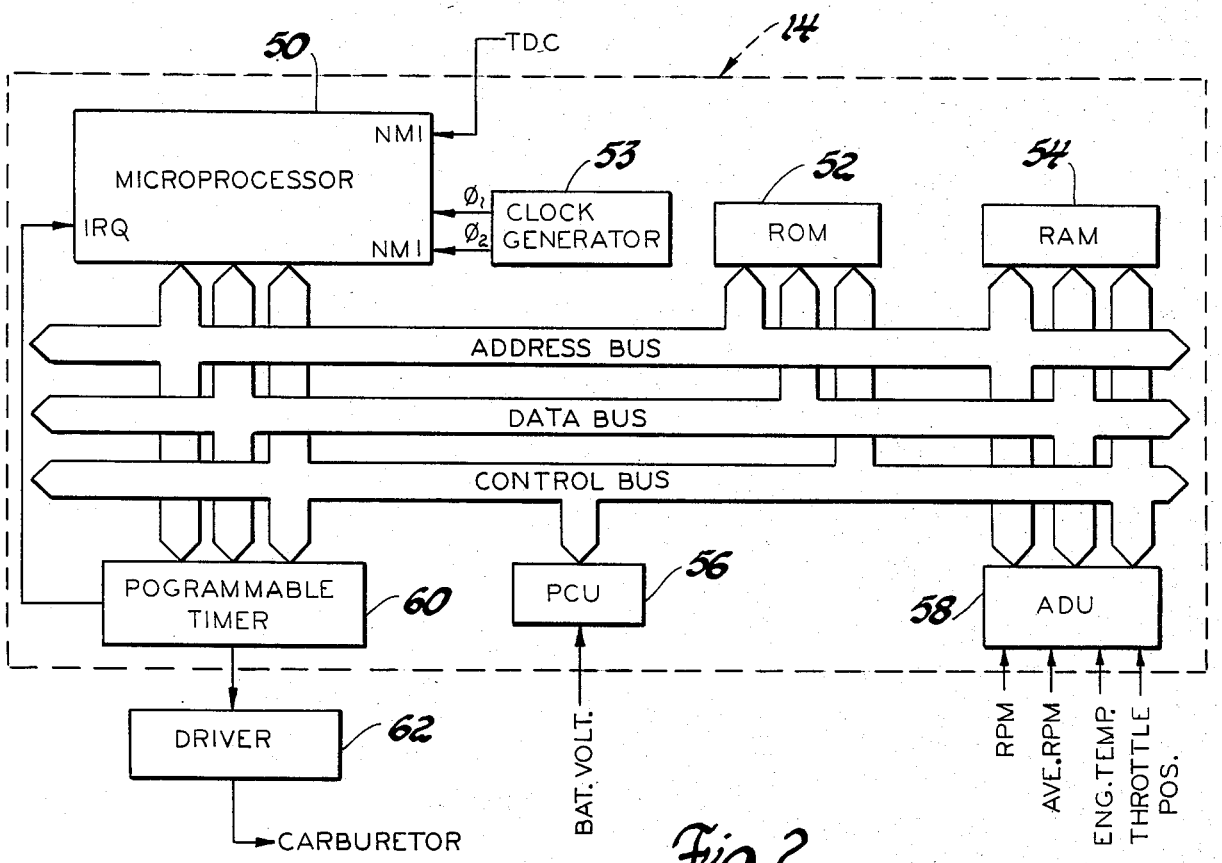
FIG. 2 illustrates a digital computer incorporated in the electronic controller of FIG. 1 for adjusting the air/fuel ratio of the internal combustion engine.

In this embodiment, the electronic controller 14 takes the form of a digital computer as illustrated in FIG. 2. The controller includes a microprocessor 50 which executes an operating program permanently stored in a read only memory (ROM) 52 which also contains calibration values utilized in the control of the air/fuel ratio supplied by the carburetor 12. Internal to the microprocessor 50 are conventional counters, registers, accumulators, flag flip flops, etc. The microprocessor 50 has an interrupt request (IRQ) input and a non-maskable interrupt (NMI) input to which the top dead center pulse generated by the processing circuit 22 of FIG. 1 is applied to command execution of a roughness detection routine to be described. Such a microprocessor may take the form of a Motorola MC-6800 series microprocessor. A clock generator 53 provides a two-phase clock signal to the microprocessor 50.

The electronic controller 14 also includes a random access memory (RAM) 54 into which data may be temporarily stored and from which data may be read at various address locations determined in accord with the program stored in the ROM 52. A power control unit (PCU) 56 receives switched voltage from the vehicle battery via the ignition switch and supplies a regulated voltage to the various circuit elements in the electronic controller 14 via the control bus. An analog-to-digital unit (ADU) 58 provides for the measurement of analog signals provided to its various inputs. In the present embodiment, those signals include the throttle position and engine temperature signals and the instantaneous and average engine speed signals provided by the processing circuits 16 and 22 of FIG. 1.

The analog signals to the ADU 58 are each sampled and converted under the control of the microprocessor 50. The conversion process is initiated on command from the microprocessor 50 which selects the particular analog input channel to be converted. At the end of the conversion cycle, the ADU 46 generates an interrupt after which the digital data is read over the data bus on command from the microprocessor 50 and stored in ROM designated memory locations in the RAM 54.

A multistage programmable timer unit 60 is provided having one timing stage for providing a timed interrupt pulse to the interrupt request input (IRQ) of the microprocessor 50. When this pulse is provided to the microprocessor 50, the microprocessor executes an IRQ routine to be described. In the present embodiment, the programmable timer unit 60 is operated to provide an interrupt request to the IRQ input of the microprocessor 50 at 100 millisecond intervals.

The programmable timer unit 60 also has a second timing stage for providing a timed output pulse as established by the microprocessor 50. This pulse is applied to the air/fuel ratio control device in the carburetor 12 via a conventional driver circuit 62. As will be described, the pulse output of the programmable timer 60 is issued during each 100 millisecond interrupt interval established by the programmable timer 60 to the IRQ input of the microprocessor 50 so as to establish a 10 hz duty cycle modulated control signal for controlling the air/fuel ratio of the mixture supplied to the engine 10 by the carburetor 12.

The programmable timer 60 may take the form of a Motorola 6840 programmable timer module configured to produce the above described timed interrupt pulse and timed output pulse.

The various elements of the electronic controller 14 are interconnected by an address bus, a data bus and a control bus. The microprocessor 50 accesses the various circuits and memory locations in the ROM 52 and the RAM 54 via the address bus. Information is transmitted between the circuits via the data bus and the control bus includes conventional lines such as read/write lines, reset lines, clock lines, power supply lines, etc.

The electronic controller 14 continually adjusts the pulse width of the signal applied to the carburetor 12 so as to cause the carburetor 12 to supply an air-fuel mixture to the engine 10 at the lean limit resulting in a maximum desired engine operating roughness. The engine operating roughness level is determined by the microprocessor 50 during execution of a roughness detection routine which is executed each time a top dead center pulse is provided to its NMI input by interrupting any other program in progress.

Figure 5:
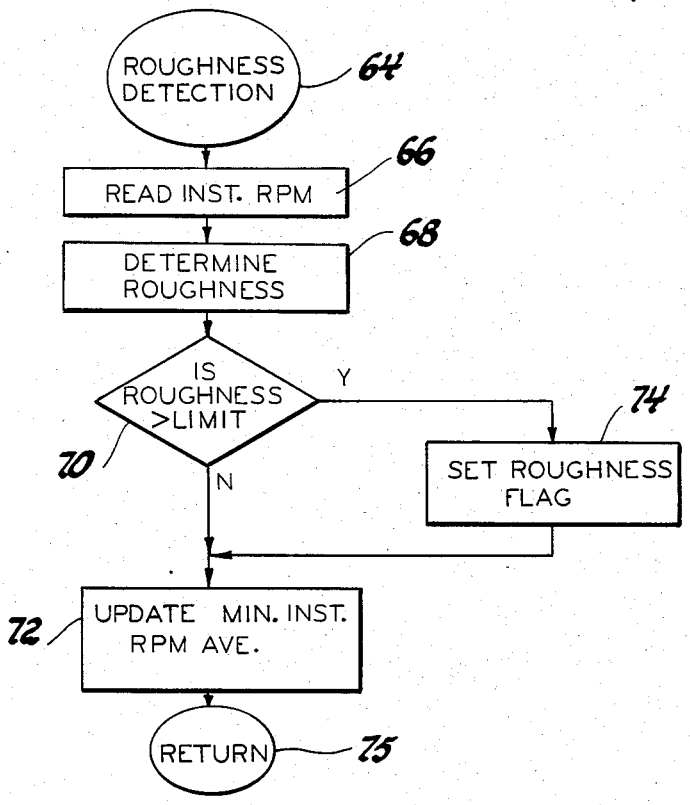
FIGS. 5, 6 and 7 are diagrams illustrative of the operation of the digital computer of FIG. 2 in carrying out the principles of this invention.

The roughness detection routine is illustrated in FIG. 5 and is entered at step 64 upon application of the top dead center pulse to the NMI input from the processing circuit 22. From this step, the program proceeds to a step 66 where the microprocessor 50 commands the ADU 58 to read the instantaneous engine speed. The value read is then stored in the RAM 54 after which the program proceeds to a step 68 where the level of engine roughness is established.

As previously described engine roughness in accord with this invention is based upon the minimum instantaneous engine speed during each combustion cycle which occurs substantially at top dead center in the compression stroke in each cylinder. Since the roughness detection routine is initiated by a top dead center pulse from the processing circuit 22, the speed read and stored at step 66 represents the minimum instantaneous speed of the engine at top dead center position of one of the cylinders of the engine. The degree of roughness is the difference between this instantaneous minimum speed and an average of the prior instantaneous minimum speed values read and stored at step 66. At step 68, engine roughness represented by the difference between a previously determined average minimum speed and the instantaneous value read and stored at 66 is determined.

The program next proceeds to a decision point 70 where the roughness level determined at step 68 is compared with a limit value representing a maximum desired engine operating roughness level. Assuming that the roughness level established at step 68 is less than the limit, the program proceeds to a step 72 where a new value of the average minimum speed value is updated based on the instantaneous speed read and stored at step 66. This value is then utilized during the next execution of the roughness detection routine at step 68 in determining the engine roughness level.

Returning to decision point 70, if it is determined that the engine roughness level exceeds the established limit, the program proceeds to a step 74 where a roughness flag in the microprocessor or alternatively a ROM designated memory location in the RAM 54 is set to indicate that the engine operation has exceeded the roughness limit. From step 74, the program then proceeds to the step 72 previously described. Following step 72, the program exits the roughness detection routine at point 75 and returns to the interrupted program routine at the point where the interruption occurred.

Figure 6:
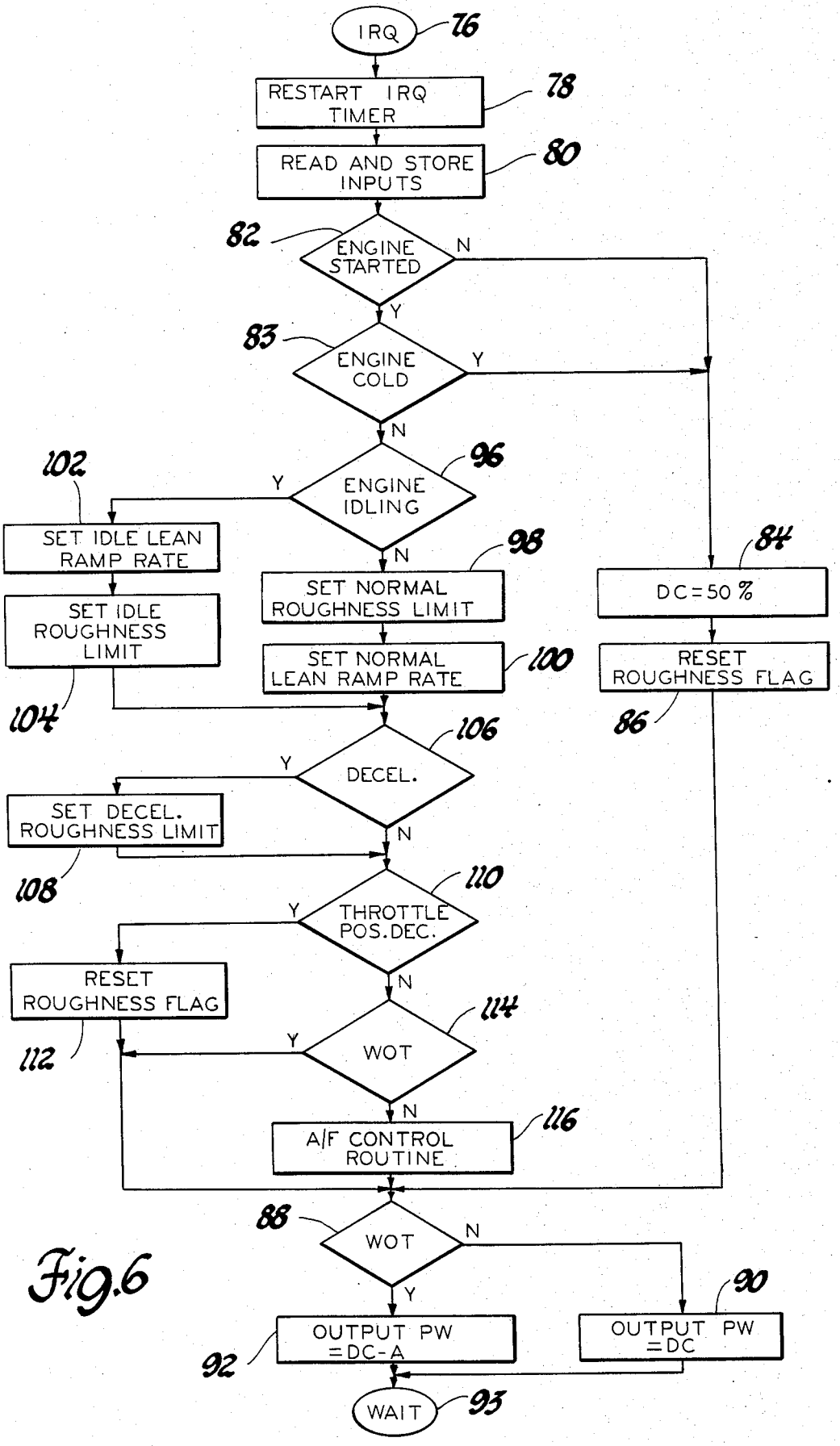

Referring now to FIG. 6, the routine executed by the microprocessor 50 upon receipt of an interrupt request applied to its IRQ input from the programmable timer 60 is illustrated. This IRQ routine is entered at step 76 and proceeds to a step 78 where the timer section in the programmable timer module 60 is re-initialized to time the next 100 millisecond interrupt period. From step 78, the program proceeds to step 80 where the ADU 58 is commanded to read the values of average rpm, engine temperature and throttle position. These values are then stored in ROM designated memory locations in the RAM 54.

From step 80, the program proceeds to a decision point 82 where the running condition of the engine is determined based on the average engine speed. If the average engine speed read and stored at step 80 indicates the engine is running, the program proceeds to decision point 83 where the temperature of the engine read and stored at step 80 is compared with a value representing cold engine operation. If the engine has not warmed up or the engine has not started as determined at decision point 82, it is not desirable to operate the engine at the lean air/fuel ratio limit and the program proceeds from decision point 82 or 83 to step 84 where a pulse width representing a 50% duty cycle is stored in a ROM designated duty cycle pulse width memory location in the RAM 54. In this embodiment where a pulse is issued to the carburetor 12 each 100 millisecond period, the value stored represents 50 milliseconds.

From step 84, the program proceeds to a step 86 where the roughness flag previously referred to at step 74 is reset. This prevents an indication of excessive engine roughness operation that may be detected during engine starting or warm-up periods.

From step 86, the program proceeds to determine at decision point 88 if the engine is at wide open throttle so that air/fuel ratio enrichment may be provided during this condition. At this point, the value of the throttle position signal stored at step 80 is compared with a value representing a wide open throttle position. If the throttle is less than wide open, the program proceeds to a step 90 where the pulse width value is read from the duty cycle pulse width memory location in the RAM 54, limited to predetermined minimum or maximum values and loaded into the programmable timer module 60 which then generates a corresponding timed pulse that is supplied to the carburetor via the driver 62.

If at decision point 88 it is determined that the throttle is at a wide open position, the program proceeds to a step 92 where the pulse width value stored in the duty cycle pulse width memory location in the RAM 54 is read, decreased by a predetermined constant A, and loaded into the programmable timer at step 90 which then generates a corresponding timed pulse. The value A represents a desired rich shift in the air/fuel ratio for power enrichment. Following either step 90 or 92, the program proceeds to a step 93 where the program waits for an interrupt at the NMI or IRQ inputs of the microprocessor 50.

Returning to decision points 82 and 83, if the engine has been started and the engine is warmed up, the program proceeds to a decision point 96 where it is determined if the engine is operating at idle. This is determined by comparing average engine speed read and stored at step 80 with an engine speed representing idle. If the engine speed is greater than idle, the program proceeds to a step 98 where the roughness limit utilized at step 70 in the routine of FIG. 5 in determining if the maximum desired engine roughness is exceeded is set to a predetermined normal engine operating roughness limit. Thereafter at step 100, a lean ramp rate value representing the normal off-idle rate at which the air/fuel ratio is to be ramped in the lean direction when the engine operating roughness is less than the limit established at step 98 is stored in the RAM.

Returning to step 96, if it is determined that the engine is at idle, the program proceeds to a step 102 where the lean ramp rate value stored in the RAM 54 is set to an idle lean ramp rate that is less than the normal off-idle lean ramp rate of step 100. Thereafter at step 104 the roughness limit utilized at step 70 of the routine of FIG. 5 is set to a predetermined idle roughness limit value that is greater than the normal roughness limit of step 98 for off-idle conditions.

From either of the steps 100 or 104, the program proceeds to a decision point 106 where it is determined if the engine 10 is under deceleration. This may be determined by monitoring the change in the average engine speed read and stored at step 80 from the previously stored value. If it is determined that the engine is decelerating, the program proceeds to a step 108 where the roughness limit used at step 70 of the routine of FIG. 5 is set to a decel roughness limit value. This value represents a roughness level greater than the normal roughness limit since when under deceleration, the engine is being driven by the vehicle and enrichment of the air/fuel ratio will not result in smoother engine operation.

From step 108 or from decision point 106 if the engine is not decelerating, the program proceeds to a decision point 110 where it is determined if the throttle position is decreasing above a predetermined rate. This condition results in normal engine operation that is difficult to distinguish from excessive engine roughness. Therefore, during the time that the throttle position is decreasing, adjustment of the air/fuel ratio is inhibited by bypassing the air/fuel ratio control routine to be described. Further, the roughness flag referred to in step 74 of the routine of FIG. 5 is reset at step 112 since a detected roughness condition may be the result of engine response to a decreasing throttle position. The program then proceeds directly to the decision point 88.

If it is determined that the throttle position is not decreasing above the predetermined rate, the program proceeds from decision point 110 to decision point 114 where it is determined if the throttle is at wide open position. If the throttle is wide open, the program proceeds to decision point 88. However, if the throttle is not wide open, the program proceeds to a step 116 where the air/fuel ratio control routine for adjusting the air and fuel mixture supplied to the engine by the carburetor 12 is executed. In summary, this routine is executed if the engine is started, the engine is warm, and the throttle position is not wide open or decreasing beyond a predetermined rate. Further, the air/fuel ratio control routine of step 116 functions to increase the air/fuel ratio when the engine operating roughness is less than the limit established at step 98, 104 or 108 at the rate established at step 100 or 102 until the engine roughness exceeds the limit as determined during the roughness detection routine of FIG. 5. When the engine roughness exceeds the limit value, the air/fuel ratio is stepped in the rich direction and thereafter ramped at a rapid rate in the rich direction until the engine operating roughness decreases below the limit value.

Figure 7:
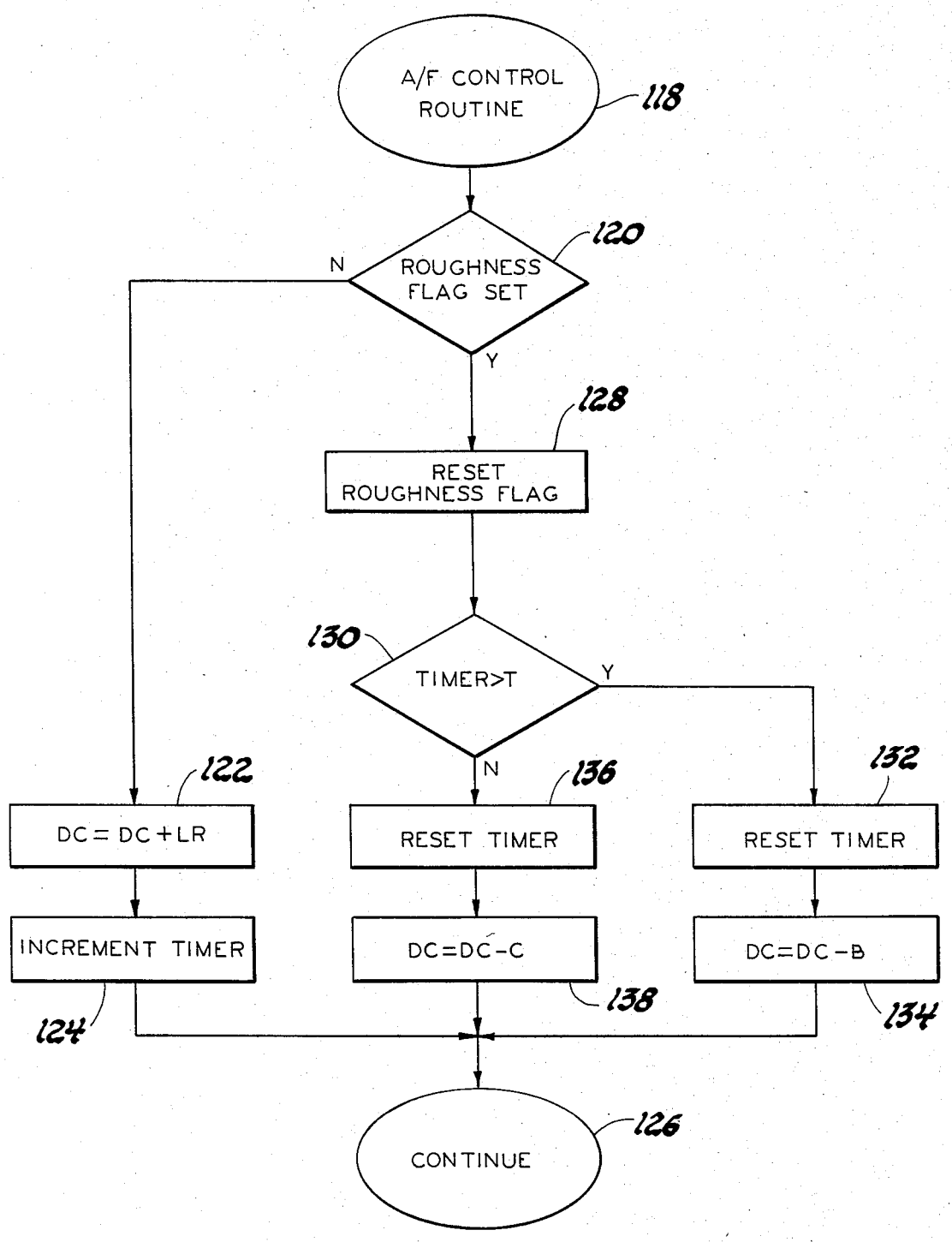

The air/fuel ratio control routine 116 is illustrated in FIG. 7 and is entered at step 118. The program then proceeds to a decision point 120 where the roughness flag is sampled to determine whether the roughness detection routine of FIG. 5 has detected an engine operating roughness exceeding the limit within the past 100 millisecond period. Assuming the roughness flag is reset indicating that an excessive engine operating roughness condition has not been detected, the program proceeds to a step 122 where the pulse width value stored in the duty cycle pulse width memory location in the RAM 54 is increased by the lean ramp rate value set at step 100 or 102 of FIG. 6. Thereafter, the program proceeds to a step 124 where a timer timing the time since the last detection of an engine operating roughness greater than the limit is incremented. Thereafter, the program exits the routine at step 126 and proceeds to decision point 88 of FIG. 6. As long as the roughness detection routine of FIG. 5 does not detect an engine operating roughness greater than the set limit, the duty cycle pulse width stored in the RAM 54 is incremented each 100 milliseconds at step 122 during execution of the air/fuel ratio control routine 118 of FIG. 6 to effectively ramp the air/fuel ratio in the lean direction at either the normal rate set at step 100 or the idle rate set at step 102.

When the air/fuel ratio is leaned to the limit at which the engine roughness exceeds the roughness limit, the excessively rough operating condition is sensed during the roughness detection routine of FIG. 5 which sets the roughness flag at step 74. This condition is sensed during the next execution of the air/fuel ratio control routine at step 120 after which the program proceeds to a step 128. At this step, the roughness flag is reset and the program proceeds to decision point 130 to determine whether the time since the engine was last operated at a roughness level exceeding the limit has exceeded a calibration time T which may be, for example, one second. If the time since the last detection of an engine operating roughness greater than the limit is greater than the time period T, the program proceeds to a step 132 where the timer is reset and then to step 134 where the pulse width value stored in the duty cycle pulse width RAM memory location is decreased by a calibration constant B to effect a step decrease in the air/fuel ratio supplied to the engine by the carburetor 12. Thereafter, the program exits the routine at step 126.

Assuming that during the next execution of the air/fuel ratio control routine, the roughness detection routine of FIG. 5 had again detected an engine operating roughness greater than the limit, the program proceeds as before to the decision point 130. However, since the timer was reset at step 132 during the prior execution of the routine, the program proceeds to a step 136 where the timer is reset and thereafter to step 138 where the pulse width value stored in the duty cycle pulse width RAM memory location is decreased by a calibration constant C that is less than the constant B to effect a decrease in the air/fuel ratio of the mixture supplied to the engine 10. Thereafter, the program exits the routine at step 126. The program proceeds from decision point 130 and then to steps 136 and 138 as long as the roughness detection routine of FIG. 5 detects an engine roughness condition. During each execution of the step 138, the pulse width value stored in the RAM 54 is decreased by the calibration constant C to effectively ramp the air/fuel ratio of the mixture supplied to the engine 10 by the carburetor 12 in the rich direction at a rate determined by the calibration constant C.

When the roughness detection routine of FIG. 5 no longer detects an engine operating roughness condition, the program again proceeds from decision point 120 to execute the steps 122 and 124 to ramp the air/fuel ratio in the lean direction as previously described.

The timer reset step 136 is provided to ensure that the timer is re-initialized if an engine roughness condition is detected within the time period T so that the timer function at step 124 is re-initialized each time an engine roughness condition is detected.

In summary, the foregoing description sets forth a lean limit air/fuel ratio controller adjusting the air/fuel ratio to a lean limit at which a maximum desired engine roughness is attained. Roughness is reliably detected by sensing the low instantaneous engine speed value during the cylinder cycle which is compared with the average value of the low instantaneous engine speeds. Further, acceptable engine operation is provided while yet maximizing engine economy by increasing the roughness limit during a detected engine idle condition.

The foregoing description of a preferred embodiment for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. For an internal combustion engine having combustion chambers and an output shaft that undergoes cyclic speed variations in response to the pressure variations in the combustion chambers representative of engine operating roughness, a system for controlling the air-fuel mixture supplied to the engine to a lean limit resulting in a maximum desired engine operating roughness, the engine tending to increase its operating roughness at engine idle conditions so that the air-fuel mixture resulting in the maximum engine operating roughness is substantially richer during an engine idle condition, the system comprising:

means effective to sense the instantaneous speed of the output shaft;

means responsive to the sensed output shaft speed effective to generate a roughness signal indicative of the roughness of the engine's operation;

means effective to generate a roughness reference signal representing the maximum desired engine roughness;

means effective to increase the air/fuel ratio of the mixture supplied to the engine at a first predetermined rate when the roughness signal is less than the roughness reference signal and to decrease the air/fuel ratio of the mixture at a second predetermined rate when the roughness signal is greater than the roughness reference signal, the air/fuel ratio at which the roughness signal is equal to the roughness reference signal comprising the lean limit of the air fuel-mixture;

means effective to sense an engine idle condition; and means responsive to a sensed engine idle condition effective to shift the roughness reference signal by a predetermined value representing a predetermined increase in the engine roughness level and decrease the rate of increase in the air/fuel ratio from the first predetermined rate to a third predetermined rate, whereby the fuel economy of the internal combustion engine is maximized by increasing the allowable engine roughness and accordingly the lean limit of the air/fuel ratio supplied to the engine during an engine idle condition.

2. A method for detecting the operating roughness level of an internal combustion engine having combustion chambers and an output shaft that undergoes cyclic speed variations in response to pressure variations in the combustion chambers associated with the compression and combustion in each combustion chamber, the method comprising the steps of:

sensing the minimum output shaft speed of each cycle of the cyclic speed variations;

averaging the sensed minimum output shaft speeds; and taking the difference between the sensed minimum output shaft speed and the average of the sensed minimum output shaft speeds, the difference being an indication of the operating roughness level of the engine.

3. For an internal combustion engine having combustion chambers and an output shaft that undergoes cyclic speed variations in response to the pressure variations in the combustion chambers representative of engine operating roughness, a system for controlling the air-fuel mixture supplied to the engine to a lean limit resulting in a maximum desired engine operating roughness, the engine tending to increase its operating roughness at engine idle conditions so that the air-fuel mixture resulting in the maximum engine operating roughness is substantially richer during an engine idle condition, the system comprising:

means effective to sense the instantaneous speed of the output shaft;

means responsive to the sensed output shaft speed effective to generate a roughness signal indicative of the roughness of the engine's operation;

means effective to generate a roughness reference signal representing the maximum desired engine roughness;

means effective to adjust the air/fuel ratio of the mixture supplied to the engine in a direction to produce an engine operating roughness at which the roughness signal is equal to the roughness reference signal, the air/fuel ratio at which the roughness signal is equal to the roughness reference signal comprising the lean limit of the air-fuel mixture;

means effective to sense an engine idle condition; and means responsive to a sensed engine idle condition effective to shift the roughness reference signal by a predetermined value representing a predetermined increase in the engine roughness level, whereby the fuel economy of the internal combustion engine is maximized by increasing the allowable engine roughness and accordingly the lean limit of the air/fuel ratio supplied to the engine during an engine idle condition.

4. The system as set forth in claim 3 wherein the means effective to generate a roughness signal is comprised of means effective to sense the minimum speed in each cycle of the cyclic speed variations of the output shaft;

means effective to average the sensed minimum speeds; and means effective to generate the roughness signal having a value equal to the difference between each sensed minimum speed and the average of the sensed minimum speeds.

* * * * *